US006047817A

United States Patent [19]

Taylor et al.

[11] Patent Number: 6,047,817

[45] Date of Patent: Apr. 11, 2000

[54] COMBINED MEDICANT DISPENSER AND DRINKING RECEPTACLE

[76] Inventors: Angela Taylor; Arthur Taylor, both of 7744 Penrose Ave., Elkins Park, Pa. 19027

[21] Appl. No.: 09/245,656

[22] Filed: Feb. 8, 1999

[51] Int. Cl.[7] ..... B65D 77/00; B65D 30/20

[52] U.S. Cl. ..... 206/217; 383/120; 383/210

[58] Field of Search ..... 206/217, 218, 206/219; 383/120, 122, 210, 211

[56] References Cited

U.S. PATENT DOCUMENTS

| | | | |
|---|---|---|---|
| 927,826 | 7/1909 | Breitmeyer . | |
| 2,766,796 | 10/1956 | Tupper | 206/217 |
| 2,932,385 | 4/1960 | Bollmeier et al. | 206/219 |
| 2,967,609 | 1/1961 | Gabbard | 206/47 |
| 3,282,411 | 11/1966 | Jardine | 206/217 |
| 3,363,750 | 1/1968 | Smith | 206/47 |
| 3,514,008 | 5/1970 | Dorn | 220/8 |
| 3,608,709 | 9/1971 | Pike | 206/219 |
| 4,387,804 | 6/1983 | Austin | 206/218 |
| 4,637,061 | 1/1987 | Riese | 206/219 |
| 5,287,961 | 2/1994 | Herran | 206/219 |
| 5,407,278 | 4/1995 | Beer | 383/38 |
| 5,423,421 | 6/1995 | Inoue et al. | 206/219 |
| 5,437,406 | 8/1995 | Gordon et al. | 383/120 |
| 5,503,477 | 4/1996 | Schlough | 383/207 |

*Primary Examiner*—Paul T. Sewell
*Assistant Examiner*—J. Mohandesi
*Attorney, Agent, or Firm*—Henderson & Sturm LLP

[57] ABSTRACT

A combined medicant dispenser and drinking receptacle 10 provided with a self contained supply of both dry medicant 100 and a quantity of water 50 to facilitate the swallowing of the dry medicant 100 by the user without having to look for an independent source of liquid. The combined medicant dispenser and drinking receptacle 10 includes a receptacle unit 11 comprising a receptacle member 20 fabricated from a rupturable thin walled material 60 and divided into an upper compartment 21 defined by a sealed upper receptacle portion 23 and provided with a dry medicant supply 100 and a lower compartment 22 defined by a sealed lower receptacle portion 25 and provided with a quantity of water 50.

6 Claims, 2 Drawing Sheets

COMBINED MEDICANT DISPENSER AND DRINKING RECEPTACLE

BACKGROUND OF THE INVENTION

1. Field of the Invention

The present invention relates to the field of medicant dispensers in general, and in particular to a combined medicant dispenser and drinking receptacle having a self-contained fluid supply.

2. Description of Related Art

As can be seen by reference to the following U.S. Pat. Nos. 927,826; 2,967,609; 3,363,750; 3,514,008; and 4,387,804, the prior art is replete with myriad and diverse medicant containers that also serve as drinking receptacles.

While all of the aforementioned prior art constructions are more than adequate for the basic purpose and function for which they have been specifically designed, they are uniformly deficient with respect to their failure to provide a simple, efficient, and practical dual compartment receptacle that contains both a medicant supply and a supply of water to facilitate the ingestion of the medicant.

As anyone who has orally taken medicant, in powdered, pill, or caplet form is all too well aware, the ingestion of the medicant in greatly facilitated by taking a quantity of water into their mouth before they attempt to swallow the medicant.

As a consequence of the foregoing situation, there has existed a longstanding need for a new and improved type of combined receptacle that not only has a prepackaged medicant supply, but which also serves as a drinking receptacle that is provided with a self contained water supply, and the provision of such a construction is a stated objective of the present invention.

BRIEF SUMMARY OF THE INVENTION

Briefly stated, the combined medicant dispenser and drinking receptacle that forms the basis of the present invention comprises in general, a main receptacle unit including a receptacle member divided into an upper relatively small receptacle compartment filled with a quantity of dry medicant in pill, powder, or caplet form and a lower relatively large receptacle compartment filled with a quantity of water to facilitate the swallowing of the dry medicant.

As will be explained in greater detail further on in the specification, the main receptacle member is provided with rupturable means for separating the interior of the receptacle unit into segregated upper and lower compartments defined by upper and lower receptacle portions. The upper receptacle portion is further provided with means for gaining access to the dry medicant either prior to, or simultaneously with, the actuation of the rupturable means that segregates the upper receptacle portion from the lower receptacle portion.

Once the medicant have been removed from the upper receptacle portion, the seal or thin walled membrane that separates the upper receptacle portion from the lower receptacle portion is ruptured so that the liquid contents in the lower receptacle can be consumed by the user either at the point of purchase or at a later time without the need for the user to find a source of water to facilitate the swallowing the medicant.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
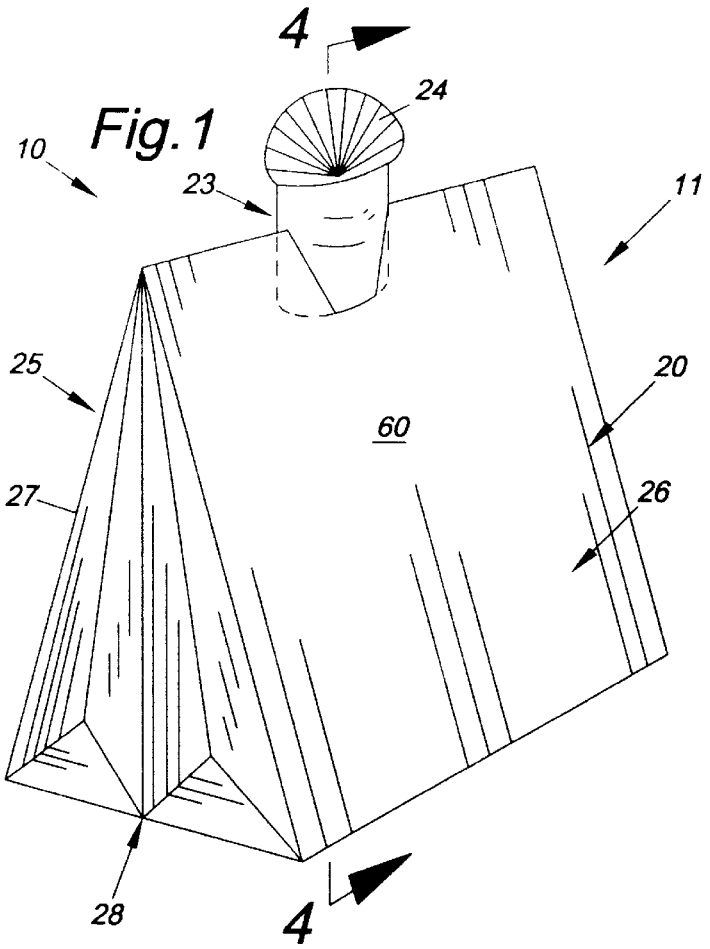
FIG. 1 is a perspective view of one version of the preferred embodiment of the combined medicant dispenser and drinking receptacle that forms the basis of the present invention.
Figure 2:
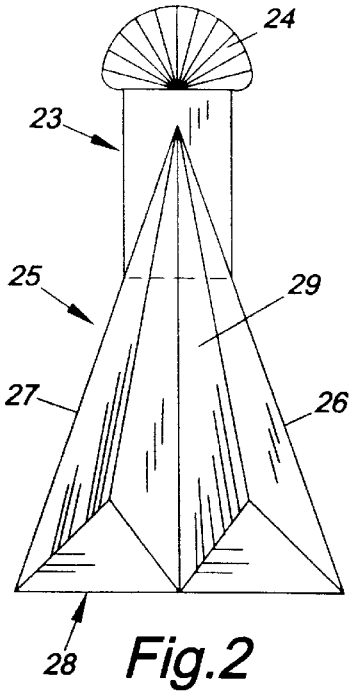
FIG. 2 is an end view of the version depicted in FIG. 1.
Figure 3:
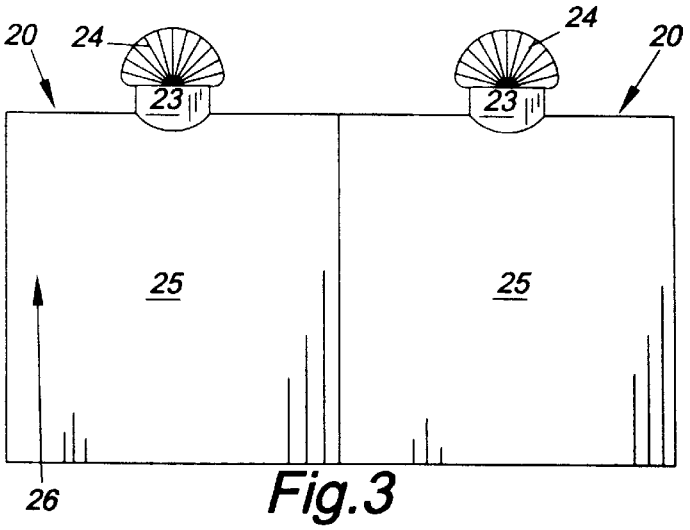
FIG. 3 is a side plan view of a pair of combined medicant dispenser and drinking receptacles disposed in a tear off relationship with one another.
Figure 4:
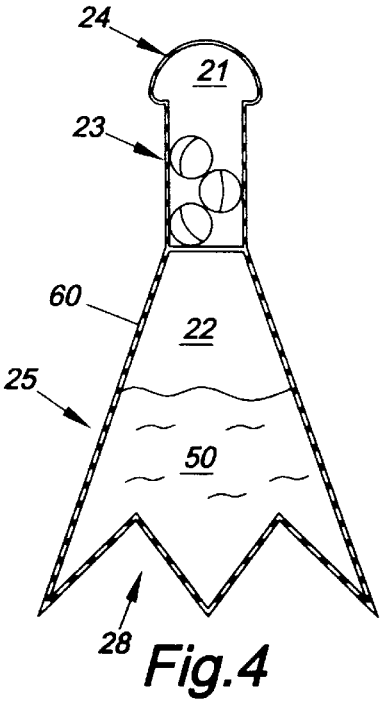
FIG. 4 is a cross sectional view taken through line 4—4 of FIG. 1.

As can be seen by reference to the drawings, and in particular to FIG. 1, the first version of the combined medicant dispenser and drinking receptacle that forms the basis of the present invention is designated generally by the reference number 10. The combined medicant dispenser and drinking receptacle 10 comprises in general, a receptacle unit 11 including a main receptacle member 20 divided into a relatively small upper receptacle compartment 21 and a relatively large lower receptacle compartment 22.

In the first version of the preferred embodiment depicted in FIGS. 1 through 4, the upper receptacle compartment 21 is defined by a generally small cylindrically shaped upper receptacle portion 23 provided with an enlarged head element 24. The upper receptacle compartment 21 is dimensioned to receive a quantity of dry medicant designated generally as 100 which includes powder, pills, caplets, etc.

In addition, the upper receptacle portion 23, fabricated from a thin walled material 60 which is frangible or rupturable to provide access into the interior of the upper receptacle compartment 22 so that the user can remove the dry medicant 100 from the interior of the upper receptacle compartment 21 without disturbing the contents of the lower receptacle compartment 22.

Still referring to FIGS. 1 through 4, it can be seen that the lower receptacle compartment 22 is defined by a relatively large lower receptacle portion 25 likewise fabricated from the thin walled material 60 including a generally rectangular front 26, and rear 27 wall panels, a pleated rectangular floor panel 28 and a pair of opposed pleated triangular side panels 29 which forms a sealed lower receptacle compartment that is filled with a quantity of water designated generally as 50.

Figure 5:
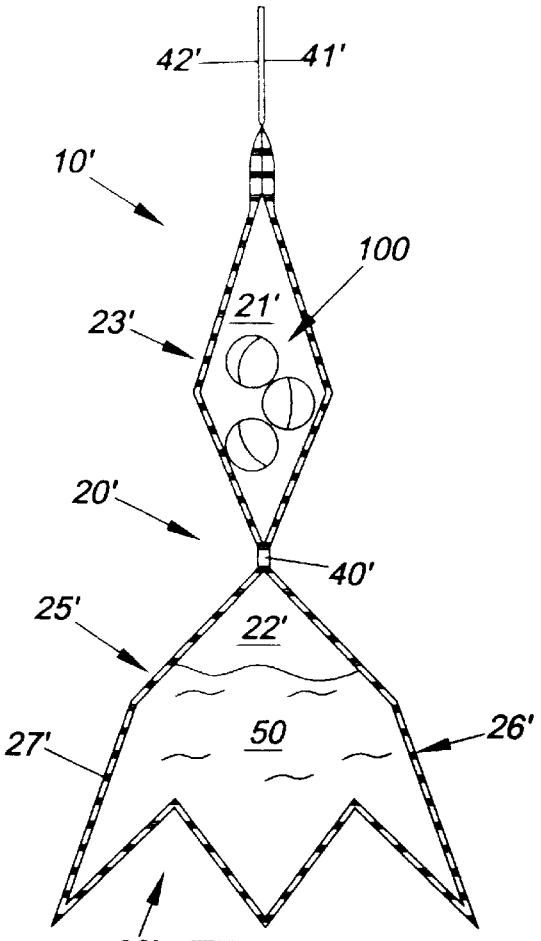
FIG. 5 is a cross sectional view of an alternate version of the preferred embodiment in the totally closed position.

Furthermore, as can best be appreciated by reference to FIG. 5, the lower end of the upper receptacle portion 23 extends into and forms a waterproof part of the lower receptacle portion 25 such that the quantity of water 50 in the lower compartment 22 cannot come into contact with the dry medicant 100 in the upper compartment 21 until the user ruptures one or more of the thin walls of the upper receptacle portion 23.

Figure 6:
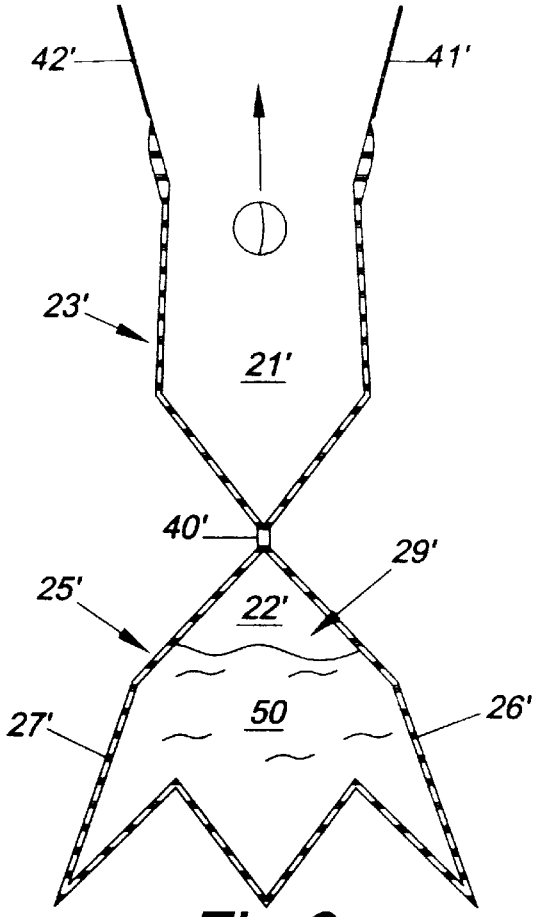
FIG. 6 is a cross sectional view of the alternate version in the partially open position.
Figure 7:
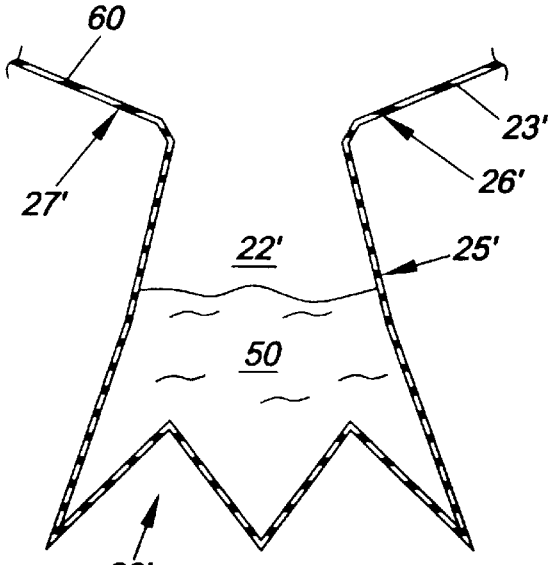
FIG. 7 is a cross sectional view of the alternate version in the fully open position.

Turning now to FIGS. 5 through 7, it can be seen that in the alternate version of the preferred embodiment, the combined medicant dispenser and drinking receptacle is designated generally as 10' and comprises a receptacle unit 11' including a main receptacle member 20' divided into a relatively small upper compartment 21' and a relatively large lower compartment. The receptacle member 20' includes a pair of rectangular front 26' and rear 27' wall panels, a pleated rectangular floor panel 28' and a pair of pleated rectangular side panels 29'. The upper part of both the front 26' and rear 27' wall panels are sealed together as at 40' to create the upper 23' and the lower 25' receptacle portions.

In addition, both the front 26' and rear 27' wall panels are provided with separable tab elements 41' and 42', respectively, that can be forcibly separated by the user to gain access to the dry medicant 100 contained with the upper compartment 21'.

Once the upper compartment 21' has been breached, the user can then grasp the front 26' and rear 27' wall panels in the upper receptacle portion 23' to rupture the internal seal 40 between the upper 23' and lower 25' receptacle portion to give the user access to the quantity of water 50 that is contained within the lower receptacle compartment 22.

By now it should be appreciated that both versions of this invention incorporate a liquid filled lower receptacle portion 25, 25' and a dry medicant filled upper receptacle portion 23, 23'. The upper and lower receptacle portions are separated by a waterproof barrier such as a waterproof thin walled membrane in the first version and a waterproof seal in the second version.

Furthermore, the rupturing of the waterproof barrier between the upper and lower receptacle portions converts the entire receptacle member into a drinking receptacle once the dry medicant have been removed from the upper receptacle portion to fulfill the express purpose and function of this invention.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

We claim:

1. A combined medicant dispenser and drinking receptacle comprising:

a receptacle unit including a receptacle member comprising: an upper receptacle portion which defines a small volume generally cylindrical upper receptacle compartment which sealingly surrounds a quantity of dry medicant; a lower receptacle portion which defines a large volume expansible lower receptacle compartment having a generally rectangular front, rear, and floor panels and a pair of generally triangular pleated side panels wherein the lower receptacle compartment contains a supply of water; and, a waterproof barrier disposed between said upper and lower receptacle portions;

first means for providing access into said upper receptacle portion; and second means for providing access into said lower receptacle portions.

2. The combined medicant dispenser and drinking receptacle as in claim 1 wherein said generally cylindrical upper receptacle portion extends partially into said lower receptacle portion.

3. The combined medicant dispenser and drinking receptacle as in claim 2 wherein said upper and lower receptacle portions share a common surface.

4. The combined medicant dispenser and drinking receptacle as in claim 3 wherein said common surface includes a thin walled membrane.

5. The combined medicant dispenser and drinking receptacle as in claim 2 wherein said first means and said second means are the same.

6. The combined medicant dispenser as in claim 4 wherein said first and second means comprise said membrane.

* * * * *